United States Patent [19]

Hand

[11] Patent Number: 5,037,583

[45] Date of Patent: Aug. 6, 1991

[54] HUMIDIFIER

[75] Inventor: Joseph M. Hand, Sheboygan Falls, Wis.

[73] Assignee: Bemis Manufacturing Company, Sheboygan Falls, Wis.

[21] Appl. No.: 512,889

[22] Filed: Apr. 23, 1990

[51] Int. Cl.[5] ..... B01F 3/04

[52] U.S. Cl. ..... 261/26; 261/107; 261/72.1; 222/23

[58] Field of Search ..... 261/107, 26, 72.1; 222/23, 41, 66

[56] References Cited

U.S. PATENT DOCUMENTS

| | | | |
|---|---|---|---|
| 796,557 | 8/1905 | Bockoven . | |
| 1,606,472 | 11/1926 | Kiefer et al. . | |
| 1,625,663 | 4/1927 | Kelly . | |
| 1,817,357 | 8/1931 | Fisher . | |
| 2,054,200 | 9/1936 | Langford | 261/107 |
| 2,730,340 | 1/1956 | Patriarca | 261/26 |
| 2,749,725 | 6/1956 | Essman et al. . | |
| 3,152,723 | 10/1964 | Perl et al. | 222/23 |
| 3,341,073 | 9/1967 | Arp et al. | 222/66 |
| 3,465,915 | 9/1969 | Harde | 222/66 |
| 3,598,370 | 8/1971 | Hoag | 261/26 |
| 3,637,194 | 1/1972 | Swimmer et al. | 261/26 |
| 3,811,661 | 5/1974 | Procter | 261/26 |
| 4,031,171 | 6/1977 | Asao et al. | 261/1 |
| 4,087,495 | 5/1978 | Umehara | 261/81 |
| 4,135,370 | 1/1979 | Hosoda et al. | 62/274 |
| 4,186,848 | 2/1980 | Walter | 222/23 |
| 4,257,989 | 3/1981 | Nishikawa | 261/4 |
| 4,338,576 | 7/1982 | Takahashi et al. | 331/67 |
| 4,698,188 | 10/1987 | Gutmann . | |
| 4,712,713 | 12/1987 | Karlis et al. | 222/41 |
| 4,921,639 | 5/1990 | Chin | 261/DIG. 48 |

FOREIGN PATENT DOCUMENTS

| | | | |
|---|---|---|---|
| 2604169 | 8/1977 | France | 261/107 |
| 0631134 | 7/1982 | Switzerland | 222/23 |

*Primary Examiner*—Tim Miles

*Attorney, Agent, or Firm*—Michael, Best & Friedrich

[57] ABSTRACT

A humidifier comprising a trough adapted to contain water, a mechanism for transferring water from the trough to the atmosphere, first and second containers adapted to contain water, and an arrangement for substantially emptying the first container into the trough before permitting water flow from the second container into the trough.

32 Claims, 3 Drawing Sheets

HUMIDIFIER

BACKGROUND OF THE INVENTION

The invention relates to humidifiers, and more particularly to evaporative home humidifiers.

A conventional home humidifier includes a reservoir or tank of water through which is passed an endless belt fabricated of an air permeable medium such as reticulated polyurethane foam. Air blown through the portion of the belt that is not in the water evaporates water from the belt and transfers the water to the atmosphere as a vapor.

Another known humidifier includes a reservoir or tank of water and a wicking element that is supported in the water on floats so that only the lower end of the wicking element is immersed in the water. The wicking element moves downwardly relative to the reservoir as the water level falls. Air blown through the wicking element evaporates water from the wicking element and transfers the water to the atmosphere.

SUMMARY OF THE INVENTION

The invention provides a humidifier utilizing a static capillary or wicking element rather than a moving belt or wicking element. The wicking element has a honeycomb or other suitable form and sits with only its bottom edge immersed in a trough of water. Wicking action causes the water to saturate the wicking element, and air is passed through the wicking element in order to transfer water vapor to the atmosphere. No belts, pulleys or other moving parts are required to wet the wicking element.

In order to permit the wicking element to remain stationary and to maintain a constant depth of immersion of the wicking element in the water trough, the depth of water in the trough is maintained substantially constant. Accordingly, the humidifier comprises one or more water bottles or containers, and, for each container, means for permitting water flow from the container into the water trough when the volume of water in the trough is below a predetermined quantity and for preventing water flow from the container into the trough when the volume of water in the trough is at or above the predetermined quantity. More particularly, each bottle has thereon a cap/valve that is normally biased closed so that the bottle can be inverted without losing water. When the bottle is lowered into the water trough, an upstanding pin in the trough opens the valve so that water can flow into the trough. Water ceases flowing out of the bottle when the water level in the trough rises above the level of the cap/valve. Water again flows out of the bottle when the water level in the trough falls below the cap/valve. Thus, the cap/valve maintains a substantially constant water level in the trough.

In a conventional humidifier in which the water level in the tank falls, the water level is easily indicated with a simple float mechanism. However, in the humidifier provided by the invention, the water level in the trough remains substantially constant while the water level in the bottle or bottles falls. As a result, conventional means for indicating a water level cannot be employed.

Accordingly, the humidifier comprises first and second water bottles, means for substantially emptying the first bottle into the trough before permitting water flow from the second bottle into the trough, means for providing a signal when the first bottle is substantially empty, and means for providing a signal when the second bottle is substantially empty. In other words, the first bottle is emptied first, and the humidifier provides a signal when the first bottle is empty, i.e., when half of the water supply is depleted. In alternative embodiments, the humidifier can include any number of sequentially emptied bottles and means for providing a signal when each bottle is emptied. Preferably, the signal providing means includes, for each bottle, a spring for moving the bottle upwardly when the bottle is empty, and a switch for providing a signal when the bottle moves upwardly.

The humidifier further comprises a fan or blower for transferring water from the wicking element to the atmosphere, and means for shutting off the blower when both of the water bottles are empty. In order to permit the humidifier to be dried out before being stored at the end of the humidifying season, the humidifier further comprises manually actuatable means for overriding the shut-off means and for operating the blower after both of the water bottles are empty. Preferably, such means includes a switch that is normally biased to an open position and that is movable to a closed position, and an electrical circuit for supplying power to the blower when the switch is in its closed position.

Other features and advantages of the invention will become apparent to those skilled in the art upon review of the following detailed description, claims and drawings.

Figure 1:
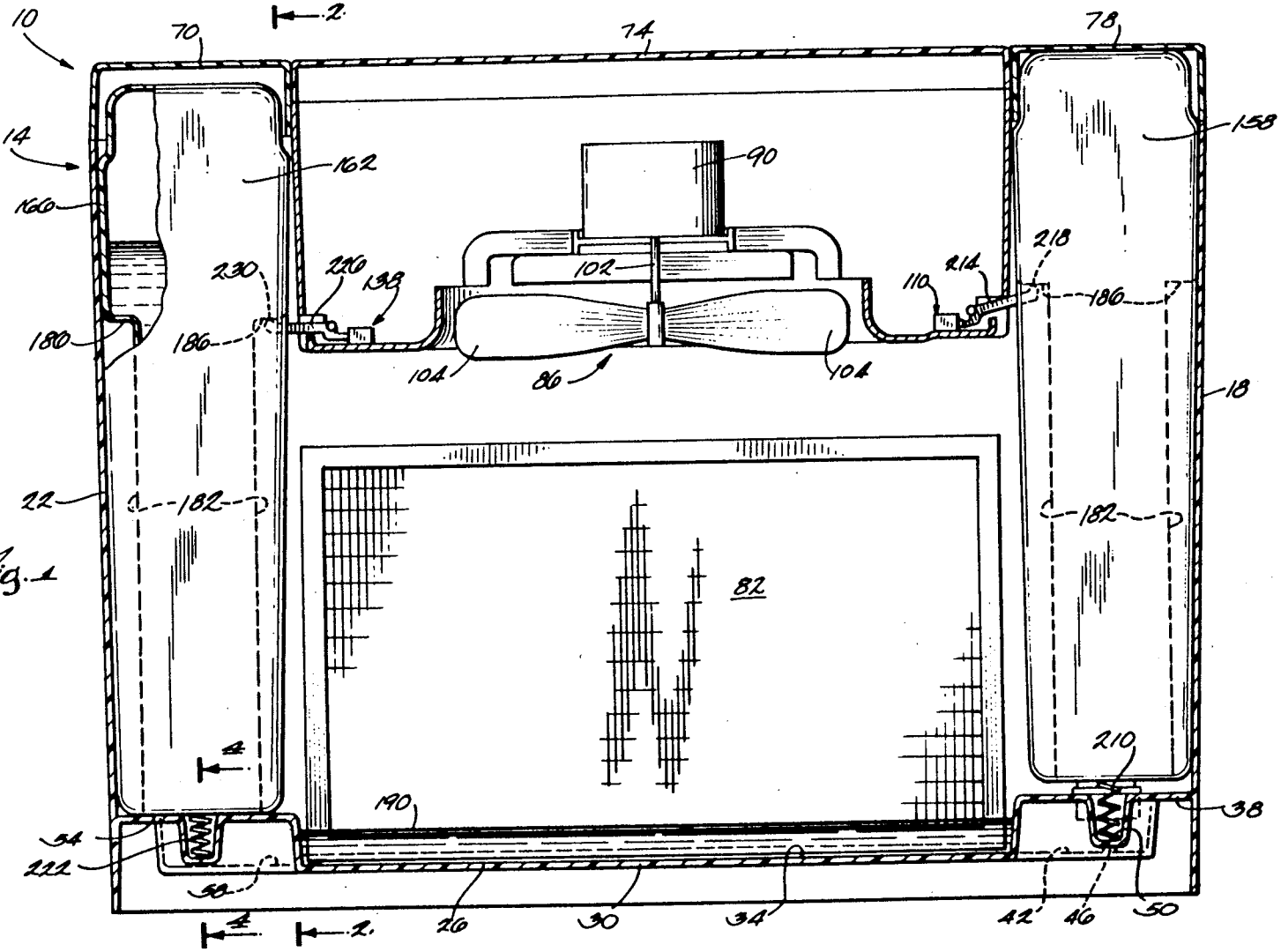
FIG. 1 is an elevational view, partially in section, of a humidifier embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 4:
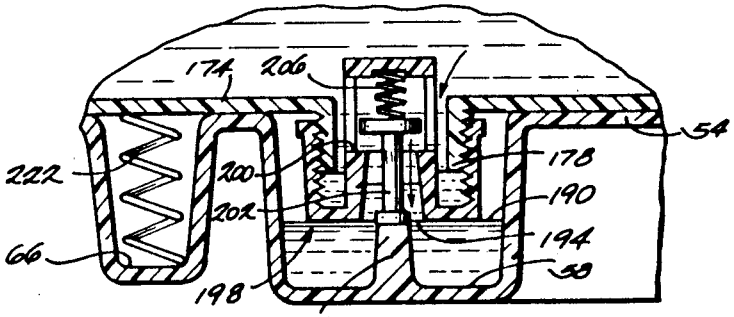
FIG. 4 is an enlarged view taken along line 4—4 in FIG. 1.

A humidifier 10 embodying the invention is illustrated in the drawings. The humidifier 10 comprises (see FIG. 1) a cabinet 14 including opposite right and left side walls 18 and 22 and a bottom wall 26 extending between the side walls 18 and 22. The bottom wall 26 includes a central portion 30 defining a trough 34 which is elongated in the direction extending between the side walls 18 and 22 and which is adapted to contain water. The bottom wall 26 also includes a right side portion 38 located adjacent the right side wall 18. The right side portion 38 includes a downwardly extending recess or channel 42 communicating with the right end of the trough 34. The right channel 42 has therein an upwardly extending pin or projection 46, the reason for which is explained hereinafter. The right side portion 38 also includes a downwardly extending depression or recess 50 spaced from the channel 42. The bottom wall 26 also includes a left side portion 54 located adjacent the left side wall 22. The left side portion 54 includes a downwardly extending recess or channel 58 communicating with the left end of the trough 34. The left channel 58 has therein (see FIGS. 2 and 4) an upwardly extending pin or projection 62, the reason for which is explained hereinafter. The left side portion 54 also includes a downwardly extending depression or recess 66 spaced from the channel 58. The cabinet 14 also includes removable left, center and right cover portions 70, 74 and 78, respectively.

The humidifier 10 also comprises means for transferring water from the trough 34 to the atmosphere. While various suitable means can be employed, in the illustrated construction, such means includes a wicking element 82 which is supported within the cabinet 14 and which includes a lower end located in the trough 34. The wicking element 82 can have any suitable construction, an example of which is disclosed in U.S. Pat. No. 4,822,533, which is incorporated herein by reference. The wicking element 82 is stationary relative to the trough 34. When a proper level of water is maintained in the trough 34, water saturates the wicking element 82. The means for transferring water to the atmosphere also includes blower means which, in the illustrated construction, includes an electric fan 86 supported with the cabinet 14. The fan 86 includes an electric motor 90 having terminals 94 and 98 (FIG. 5), and a shaft 102 (FIG. 1) which is driven by the motor 90 and which has thereon a plurality of fan blades 104. The fan 86 blows air through the wicking element 82, and the air transfers water vapor to the atmosphere.

Figure 2:
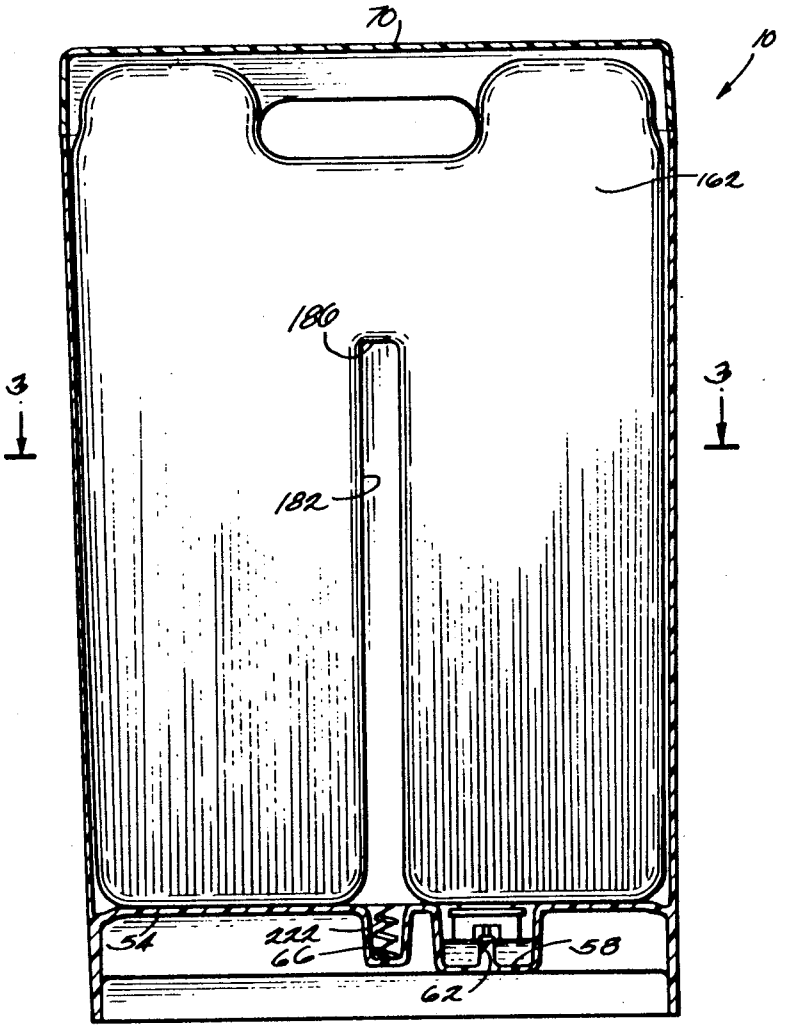
FIG. 2 is a view taken along line 2—2 in FIG. 1.
Figure 5:
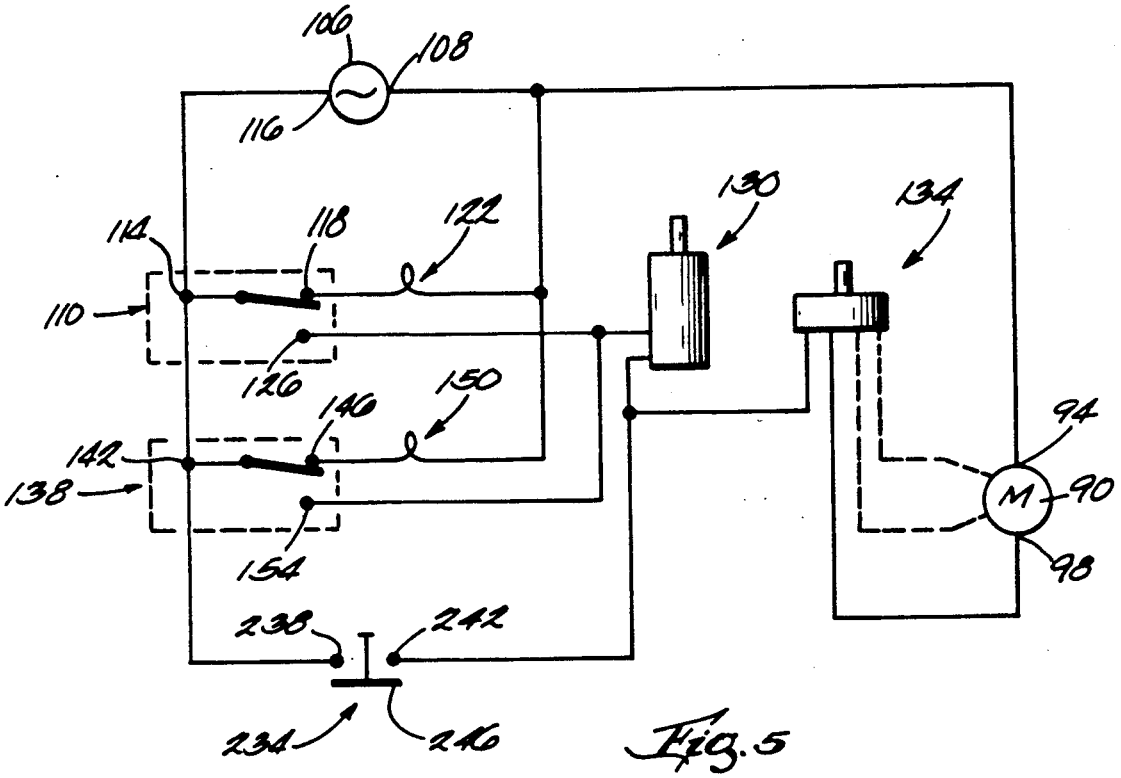
FIG. 5 is a schematic view of the electrical circuitry of the humidifier.

The means for transferring water to the atmosphere also includes means for supplying power to the fan 86. While various suitable means can be used, in the illustrated embodiment, such means includes (see FIG. 5) an electrical power source 106 having a first side 108 connected to the motor terminal 94. The power supply means also includes a first or right switch 110 (FIGS. 1 and 5). The switch 110 is preferably a three-pole switch having (see FIG. 5) a first terminal 114 connected to the second side 116 of the power source 106, a second terminal 118 connected to the first side 108 of the power source 106 through a first or right indicator lamp 122, and a third terminal 126 connected to the motor terminal 98 through a conventional humidistat 130 and a conventional motor speed control 134 operably connected to the motor 90 (as indicated by the dotted lines in FIG. 5). The switch 110 has a first condition (not shown) in which the terminals 114 and 126 are connected so that current flows through the humidistat 130, the speed control 134 and the motor 90, and a second condition (FIG. 5) in which the switch terminals 114 and 118 are connected so that current flows through the right indicator lamp 122.

The power supply means also includes a second or left switch 138 (FIGS. 1 and 5). The switch 138 is preferably identical to the switch 110 and has (see FIG. 5) a first terminal 142 connected to the second side 116 of the power source 106, a second terminal 146 connected to the first side 108 of the power source 106 through a second or left indicator lamp 150, and a third terminal 154 connected to the motor terminal 98 through the humidistat 130 and the motor speed control 134. The switch 138 has a first condition (not shown) in which the terminals 142 and 154 are connected so that current flows through the humidistat 130, the speed control 134 and the motor 90, and a second condition (FIG. 5) in which the switch terminals 142 and 146 are connected so that current flows through the left indicator lamp 150.

Thus, the humidifier 10 comprises means for supplying power to the fan 86 when either of the switches 110 and 138 is in its first condition.

Figure 3:
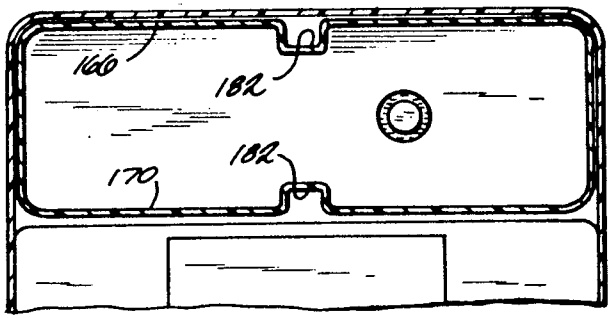
FIG. 3 is a view taken along line 3—3 in FIG. 2.

The humidifier 10 further comprises container means adapted to contain water. Preferably, the container means includes (see FIG. 1) substantially identical first and second or right and left water bottles or containers 158 and 162, respectively. Each of the containers 158 and 162 includes opposite side walls 166 and 170 (FIGS. 1 and 3) and a bottom wall 174 (FIG. 4) having thereon an outlet portion 178. Each of the side walls 166 and 170 has therein (see FIGS. 1–3) a centrally disposed groove 182 extending upwardly from the bottom wall 178. The upper end of each groove 182 is defined by a downwardly facing surface 186 (FIG. 1). The left water bottle 162 is located within the cabinet 14 with the lower end of the left water bottle 162 supported by the left side portion 54 of the bottom wall 26 of the cabinet 14. The right water bottle 158 is located within the cabinet 14 with the lower end of the right water bottle 158 supported by the right side portion 38 of the bottom wall 26 of the cabinet 14. The outlet portion 178 of the left bottle 162 extends into the left channel 58, and the outlet portion 178 of the right bottle 158 extends into the right channel 42.

The humidifier 10 further comprises means for substantially emptying the right bottle 158 into the trough 34 before permitting water flow from the left bottle 162 into the trough 34. While various suitable means can be employed, in the illustrated construction, such means includes control means for permitting water flow from the right bottle 158 into the trough 34 when the volume of water in the trough 34 is below a first predetermined quantity, for preventing water flow from the right bottle 158 into the trough 34 when the volume of water in the trough 34 is at or above the first predetermined quantity, for permitting water flow from the left bottle 162 into the trough 34 when the volume of water in the trough 34 is below a second predetermined quantity less than the first predetermined quantity, and for preventing water flow from the left bottle 162 into the trough 34 when the volume of water in the trough 34 is at or above the second predetermined quantity. In other words, the emptying means permits water flow from the right bottle 158 into the trough 34 when the level of water in the trough 34 is below a first predetermined level, prevents water flow from the right bottle 158 into the trough 34 when the level of water in the trough 34 is at or above the first predetermined level, permits water flow from the left bottle 162 into the trough 34 when the level of water in the trough 34 is below a second predetermined level 190 (shown in FIGS. 1, 2 and 4) below the first predetermined level, and prevents water flow from the left bottle 162 into the trough 34 when the level of water in the trough 34 is at or above the second predetermined level 190.

While various suitable control means can be employed, in the illustrated embodiment, such means includes first or right valve means for permitting water flow from the right container 158 when the water level in the trough 34 is below the below-described outlet 194 of the right bottle 158 and for preventing water flow from the right bottle 158 when the water level in the trough 34 is at or above the outlet 194 of the right bottle 158. Such means also includes second or left valve means for permitting water flow from the left bottle 162 when the level of water in the trough 34 is below the below-described outlet 194 of the left bottle 162 and for preventing water flow from the left bottle 162 when the level of water in the trough 34 is at or above the outlet 194 of the left bottle 162.

While various suitable valve means can be used, in the illustrated construction, each of the right and left valve means includes (see FIG. 4) a cap/valve apparatus 198 removably threaded onto the outlet portion 178 of the associated water bottle. The cap/valve apparatus 198 has a lower end having therein an opening which communicates with the outlet portion 178 of the associated bottle and which defines the outlet 194 of the associated bottle. The cap/valve apparatus 198 includes a valve seat 200, and a plunger 202 movable between an upper or open position (shown in FIG. 4) wherein the plunger 202 is located above the seat 200 and permits water flow through the cap/valve apparatus 198, and a lower or closed position (not shown) wherein the plunger 198 is seated on the seat 200 and prevents water flow through the cap/valve apparatus 198. Furthermore, the plunger 202 extends downwardly from the cap/valve apparatus 198 when the plunger 202 is in its lower or closed position. The plunger 202 is biased to its closed position by a spring 206. When the associated water bottle is placed in the cabinet 14 so that the bottle rests on the associated side portion of the bottom wall 26, the cap/valve apparatus 198 extends into the associated channel 42 or 58 and the pin 46 or 62 engages the plunger 202 and moves the plunger 202 to its open position. Water then flows out of the associated water bottle until the level of water in the trough 34 and in the channels 42 and 58 rises to the level of the outlet 194 of the bottle. Thereafter, water does not flow out of the bottle until the level of water in the trough 34 falls below the outlet 194 of the bottle.

In order to cause the right bottle 158 to be emptied before the left bottle 162 is emptied, the control means also includes means for supporting the outlet 194 of the bottle 158 above the outlet 194 of the bottle 162. While various suitable supporting means can be used, in the illustrated embodiment, this means includes means for supporting the right water bottle 158 above the left water bottle 162. In the illustrated construction, the right side portion 38 of the bottom wall 26 is located above the left side portion 54 of the bottom wall 26, so that the right water bottle 158 is located above the left water bottle 162 when both water bottles are supported by their respective side portions of the bottom wall 26.

Accordingly, when one of the bottles 158 and 162 is initially placed in the cabinet 14 so that the associated pin 46 or 62 moves the associated plunger 202 to its open position, water flows out of the bottle and into the trough 34 until the water level in the trough 34 rises to the level of the bottle outlet 194. If the right bottle 158 is placed in the cabinet 14 first, no appreciable amount of water will flow out of the left bottle 162 when the left bottle 162 is placed in the cabinet 14, because the water level in the trough 34 will already be above the level 190 of the left bottle outlet 194. If the left bottle 162 is placed in the cabinet 14 first, water will flow out of the right bottle 158, when the right bottle 158 is placed in the cabinet, until the water level in the trough 34 rises to the level of the outlet 194 of the right bottle 158. Thereafter, water will flow only out of the right bottle 158 until the right bottle 158 is substantially empty, because water flow out of the right bottle 158 will keep the water level in the trough 34 above the level of the left bottle outlet 194. Once the right bottle 158 is substantially empty, the water level in the trough 34 will fall to the level 190 of the outlet 194 of the left bottle 162, after which water will flow out of the left bottle 162 until the left bottle 162 is substantially empty.

The humidifier 10 further comprises first means for providing a signal when the right container 158 is substantially empty. While various suitable means can be used, in the illustrated construction, such means includes means for moving the right bottle 158 upwardly when the right bottle 158 is substantially empty. Preferably, the means for moving the right bottle 158 upwardly includes means for biasing the right bottle 158 upwardly. In the illustrated construction, such means includes (see FIG. 1) a spring 210 housed in the recess 50 and extending between the lower wall of the recess 50 and the bottom wall 174 of the right bottle 158. The spring 210 is compressed when the right bottle 158 rests on the right side portion 38 of the bottom wall 26, and the spring 210 extends when the right bottle 158 is substantially empty so as to move the right bottle 158 upwardly to a position above the right side portion 38 of the bottom wall 26. The signal means also includes means for providing a signal when the right bottle 158 moves upwardly. While various suitable means can be employed, in the illustrated embodiment, such means includes the right switch 110, and means for switching the right switch 110 to its second condition when the right bottle 158 moves upwardly. Preferably, the means for switching the right switch 110 to its second condition includes (see FIG. 1) a first or right arm 214 operably connected to the right switch 110 and movable between first and second or lower and upper positions respectively corresponding to the first and second conditions of the switch 110. The arm 214 is biased to its upper position and has an outer end 218. When the right container 158 is resting on the right side portion 38 of the bottom wall 26, i.e., when the right container 158 is not substantially empty, the downwardly facing surface 186 on the inner side of the right container 158 engages the outer end 218 of the arm 214 so as to maintain the arm 214 in its lower position. (The arm 214 extends into the groove 182 on the inner side of the container 158 as the container 158 is lowered into the cabinet 14. Because each side of the container has therein a groove 182, the container 158 can be placed in the cabinet 14 with either side facing inwardly. The same is true for the left container 162.) When the right container moves upwardly, i.e., when the right container 158 becomes substantially empty, the downwardly facing surface 186 on the inner side of the container 158 moves upwardly so as to permit movement of the arm 214 to its upper position. Therefore, the switch 110 is switched to its second condition when the right container 158 becomes substantially empty. As explained above, current flows through the right indicator lamp 122 when the switch 110 is in its second condition. Accordingly, the right indicator lamp 122 provides a signal when the right bottle 158 is substantially empty.

The humidifier 10 also comprises second means for providing a signal when the left bottle 162 is substantially empty. While various suitable means can be used, in the illustrated construction, such means includes means for moving the left bottle 162 upwardly when the left bottle 162 is substantially empty. Preferably, the means for moving the left bottle 162 upwardly includes means for biasing the left bottle 162 upwardly. In the illustrated construction, such means includes (see FIG. 2) a spring 222 housed in the recess 66 and extending between the lower wall of the recess 66 and the lower end of the left bottle 162. The spring 222 is compressed when the left bottle 162 rests on the left side portion 54 of the bottom wall 26, and the spring 222 extends when the left bottle 162 is substantially empty so as to move the left bottle 162 upwardly to a position above the left side portion 54 of the bottom wall 26. The signal means also includes means for providing a signal when the left bottle 162 moves upwardly. While various suitable means can be employed, in the illustrated embodiment, such means includes the left switch 138, and means for switching the left switch 138 to its second condition when the left bottle 162 moves upwardly. Preferably, the means for switching the left switch 138 to its second condition includes (see FIG. 1) a second or left arm 226 operably connected to the left switch 138 and movable between first and second or lower and upper positions respectively corresponding to the first and second conditions of the switch 138. The arm 226 is biased to its upper position and has an outer end 230. When the left container 162 is resting on the left side portion 54 of the bottom wall 26, i.e., when the left container 162 is not substantially empty, the downwardly facing surface 186 on the inner side of the left container 162 engages the outer end 230 of the arm 226 so as to maintain the arm 226 in its lower position. When the left container 162 moves upwardly, i.e., when the left container 162 becomes substantially empty, the downwardly facing surface 186 on the inner side of the container 162 moves upwardly so as to permit movement of the arm 226 to its upper position. Therefore, the switch 138 is switched to its second condition when the left container 162 becomes substantially empty. As explained above, current flows through the left indicator lamp 150 when the switch 138 is in its second condition. Accordingly, the left indicator lamp 150 provides a signal when the left bottle 162 is substantially empty.

The humidifier 10 further comprises means for shutting off the fan 86 when both of the water bottles 158 and 162 are substantially empty. While various suitable means can be used, in the illustrated construction, such means includes means for interrupting the power supply to the fan 86 when both of the switches 110 and 138 are in the second condition. As explained above, current flowing through the switches 110 and 138 flows through the indicator lamps 122 and 150 and does not flow through the motor 90 when both switches 110 and 138 are in the second condition. Thus, the shut-off means includes the switches 110 and 138.

The humidifier 10 further comprises manually actuatable means for overriding the shut-off means and for operating the fan 86 after both of the water bottles 158 and 162 are substantially empty. While various suitable means can be used, in the illustrated construction, such means includes (see FIG. 5) a third or dry-out switch 234 which has open and closed conditions and which is normally biased to its open condition, and means for supplying power to the fan 86 when the dry-out switch 234 is in its closed condition. As shown in FIG. 5, the dry-out switch 234 includes a first terminal 238 connected to the side 116 of the power source 106, and a second terminal 242 connected to the other side 108 of the power source 106 through the speed control 134 and the motor 90. The dry-out switch 234 also includes a manually movable switching element 246 movable between an open position (shown in FIG. 5) wherein the switch terminals 238 and 242 are not connected, and a closed position wherein the switching element 246 connects the switch terminals 238 and 242. Accordingly, when the dry-out switch 234 is in its closed condition, power is supplied to the fan 86 regardless of the conditions of the right and left switches 110 and 138.

Various features of the invention are set forth in the following claims.

I claim:

1. A humidifier comprising a container adapted to contain water, means for transferring water from said container to the atmosphere, and means for providing a signal when said container is substantially empty, said signal means including means for moving said container upwardly when said container is substantially empty, and means for providing a signal when said container moves upwardly.

2. A humidifier as set forth in claim 1 wherein said means for moving said container upwardly includes means for biasing said container upwardly.

3. A humidifier as set forth in claim 1 wherein said transferring means includes a trough adapted to contain water, means for transferring water from said trough to the atmosphere, and a wicking element having a lower end located in said trough.

4. A humidifier as set forth in claim 3 wherein said wicking element is stationary.

5. A humidifier as set forth in claim 1 wherein said transferring means includes blower means, and wherein said humidifier further comprises means for shutting off said blower means when both of said containers are substantially empty.

6. A humidifier as set forth in claim 5 and further comprising manually actuatable means for overriding said shut-off means and for operating said blower means after both of said containers are substantially empty.

7. A humidifier as set forth in claim 1 wherein said transferring means includes a trough adapted to contain water, means for transferring water from said trough to the atmosphere, and control means for permitting water flow from said container into said trough when the volume of water in said trough is below a predetermined quantity, and for preventing water flow from said container into said trough when the volume of water in said trough is at or above said predetermined quantity.

8. A humidifier as set forth in claim 7 wherein said control means permits water flow from said container into said trough when the level of water in said trough is below a predetermined level, and prevents water flow from said container into said trough when the level of water in said trough is at or above said predetermined level.

9. A humidifier as set forth in claim 8 wherein said container includes an outlet, and wherein said control means includes valve means for permitting water flow from said container when the water level in said trough is below said outlet and for preventing water flow from said container when the water level in said trough is at or above said outlet.

10. A humidifier as set forth in claim 1 wherein said signal means includes a switch having first and second conditions, and means for switching said switch to said second condition when said container moves upwardly.

11. A humidifier as set forth in claim 10 wherein said container includes a downwardly facing surface, wherein said means for switching said switch to said second condition includes an arm operably connected to said switch and movable between first and second positions respectively corresponding to said first and second conditions of said switch, wherein said surface engages said arm so as to maintain said arm in said first position when said container is not substantially empty, and wherein said surface moves upwardly so as to permit movement of said arm to said second position when said container moves upwardly.

12. A humidifier as set forth in claim 10 wherein said transferring means includes blower means, and wherein said humidifier further comprises means for supplying power to said blower means when said switch is in said first condition.

13. A humidifier as set forth in claim 12 wherein said humidifier further comprises means for shutting off said blower means when said container is substantially empty.

14. A humidifier as set forth in claim 13 wherein said shut-off means includes means for interrupting the power supply to said blower means when said switch is in said second condition.

15. A humidifier as set forth in claim 14 and further comprising manually actuatable means for overriding said shut-off means and for operating said blower means after said container is substantially empty.

16. A humidifier as set forth in claim 15 wherein said manually actuatable means includes a second switch having open and closed conditions and being normally biased to said open condition, and means for supplying power to said blower means when said second switch is in said closed condition.

17. A humidifier comprising a trough adapted to contain water, means for transferring water from said trough to the atmosphere, said transferring means comprising a stationary wicking element having a lower end located in said trough, blower means, and means for supplying power to said blower means, first and second containers adapted to contain water, said first and second containers having respective first and second outlets, means for substantially emptying said first container into said trough before permitting water flow from said second container into said trough, said emptying means having first valve means for permitting water flow from said first container when the water level in said trough is below said first outlet and for preventing water flow from said first container when the water level in said trough is at or above said first outlet, second valve means for permitting water flow from said second container when the level of water in said trough is below said second outlet and for preventing water flow from said second container when the level of water in said trough is at or above said second outlet, and means for supporting said first outlet above said second outlet, first means for providing a signal when said first container is substantially empty, said first means including means for moving said first container upwardly when said first container is substantially empty, and means for providing a signal when said first container moves upwardly, second means for providing a signal when said second container is substantially empty, said second means including means for moving said second container upwardly when said second container is substantially empty, and means for providing a signal when said second container moves upwardly, means for shutting off said blower means when both of said containers are substantially empty, and manually actuatable means for overriding said shut-off means and for operating said blower means after both of said containers are substantially empty.

18. A humidifier comprising a trough adapted to contain water, means for transferring water from said trough to the atmosphere, first and second containers adapted to contain water, means for supplying water from said first and second containers to said trough, first means for providing a signal when said first container is substantially empty, said first signal means including means for moving said first container upwardly when said first container is substantially empty, and means for providing a signal when said first container moves upwardly, and second means for providing a signal when said second container is substantially empty, said second signal means including means for moving said second container upwardly when said second container is substantially empty, and means for providing a signal when said second container moves upwardly.

19. A humidifier as set forth in claim 18 wherein said means for moving said first container upwardly includes means for biasing said first container upwardly, and wherein said means for moving said second container upwardly includes means for biasing said second container upwardly.

20. A humidifier as set forth in claim 18 wherein said first container includes a first outlet, wherein said second container includes a second outlet, and wherein said supplying means includes first valve means for permitting water flow from said first container when the water level in said trough is below said first outlet and for preventing water flow from said first container when the water level in said trough is at or above said first outlet, and second valve means for permitting water flow from said second container when the water level in said trough is below said second outlet and for preventing water flow from said second container when the water level in said trough is at or above said second outlet.

21. A humidifier as set forth in claim 18 wherein said transferring means includes a stationary wicking element having a lower end located in said trough.

22. A humidifier as set forth in claim 18 and further comprising means for substantially emptying said first container into said trough before permitting water flow from said second container into said trough.

23. A humidifier as set forth in claim 22 wherein said emptying means includes control means for permitting water flow from said first container into said trough when the volume of water in said trough is below a first predetermined quantity, for preventing water flow from said first container into said trough when the volume of water in said trough is at or above said first predetermined quantity, for permitting water flow from said second container into said trough when the volume of water in said trough is below a second predetermined quantity less than said first predetermined quantity, and for preventing water flow from said second container into said trough when the volume of water in said trough is at or above said second predetermined quantity.

24. A humidifier as set forth in claim 22 wherein said emptying means permits water flow from said first container into said trough when the level of water in said trough is below a first predetermined level, prevents water flow from said first container into said trough when the level of water in said trough is at or above said first predetermined level, permits water flow from said second container into said trough when the level of water in said trough is below a second predetermined level below said first predetermined level, and prevents water flow from said second container into said trough when the level of water in said trough is at or above said second predetermined level.

25. A humidifier as set forth in claim 24 wherein said first and second containers include respective first and second outlets, and wherein said emptying means includes first valve means for permitting water flow from said first container when the water level in said trough is below said first outlet and for preventing water flow from said first container when the water level in said trough is at or above said first outlet, second valve means for permitting water flow from said second container when the level of water in said trough is below said second outlet and for preventing water flow from said second container when the level of water in said trough is at or above said second outlet, and means for supporting said first outlet above said second outlet.

26. A humidifier as set forth in claim 18 wherein said first signal means includes a first switch having first and second conditions, and means for switching said first switch to said second condition when said first container moves upwardly, and wherein said second signal means includes a second switch having first and second conditions, and means for switching said second switch to said second condition when said second container moves upwardly.

27. A humidifier as set forth in claim 26 wherein said first container includes a first downwardly facing surface, wherein said means for switching said first switch to said second condition includes a first arm operably connected to said first switch and movable between first and second positions respectively corresponding to said first and second conditions of said first switch, wherein said first surface engages said first arm so as to maintain said first arm in said first position when said first container is not substantially empty, wherein said first surface moves upwardly so as to permit movement of said first arm to said second position when said first container moves upwardly, wherein said second container includes a second downwardly facing surface, wherein said means for switching said second switch to said second condition includes a second arm operably connected to said second switch and movable between first and second positions respectively corresponding to said first and second conditions of said second switch, wherein said second surface engages said second arm so as to maintain said second arm in said first position when said second container is not substantially empty, and wherein said second surface moves upwardly so as to permit movement of said second arm to said second position when said second container moves upwardly.

28. A humidifier as set forth in claim 26 wherein said means for transferring water includes blower means, and wherein said humidifier further comprises means for supplying power to said blower means when either of said first and second switches is in said first condition.

29. A humidifier as set forth in claim 28 wherein said humidifier further comprises means for shutting off said blower means when both of said containers are substantially empty.

30. A humidifier as set forth in claim 29 wherein said shut-off means includes means for interrupting the power supply to said blower means when both of said first and second switches are in said second condition.

31. A humidifier as set forth in claim 30 and further comprising manually actuatable means for overriding said shut-off means and for operating said blower means after both of said containers are substantially empty.

32. A humidifier as set forth in claim 31 wherein said manually actuatable means includes a third switch having open and closed conditions and being normally biased to said open condition, and means for supplying power to said blower means when said third switch is in said closed condition.

* * * * *